United States Patent [19]

Schultes

[11] 3,980,322

[45] Sept. 14, 1976

[54] SKI STOPPER

[75] Inventor: Hermann Schultes, Hohenems, Austria

[73] Assignee: Olin Corporation, New Haven, Conn.

[22] Filed: July 23, 1975

[21] Appl. No.: 598,318

Related U.S. Application Data

[62] Division of Ser. No. 528,292, Nov. 29, 1974, Pat. No. 3,918,730.

[52] U.S. Cl. ..... 280/605; 280/637

[51] Int. Cl.[2] ..... A63C 7/10

[58] Field of Search ..... 280/11.13 B, 11.13 C, 280/11.13 Z, 11.35 N, 604, 605, 637

[56] References Cited

UNITED STATES PATENTS

| | | | |
|---|---|---|---|
| 3,785,663 | 1/1974 | Spieldiener | 280/11.13 B |
| 3,884,488 | 5/1975 | Riedel | 280/11.35 N |
| 3,899,184 | 8/1975 | Haddad | 280/11.13 B |
| 3,918,730 | 11/1975 | Schultes | 280/11.13 B |

FOREIGN PATENTS OR APPLICATIONS

| | | | |
|---|---|---|---|
| 845,419 | 8/1939 | France | 280/11.13 B |

*Primary Examiner*—Robert R. Song
*Assistant Examiner*—David M. Mitchell
*Attorney, Agent, or Firm*—Donald R. Motsko; William W. Jones

[57] ABSTRACT

A device for stopping a runaway ski from sliding down a hill after a skier has fallen and the ski has been released from the skier's foot. Provision is made so that the ski will not be released from the skier's foot in a static drop situation, such as where the ski accidentally comes loose from the skier's foot while the skier is riding on a lift, but will be released in a dynamic release situation, such as where the skier falls while skiing.

2 Claims, 9 Drawing Figures

SKI STOPPER

This is a division of application Ser. No. 528,292, filed Nov. 29, 1974, now U.S. Pat. No. 3,918,730.

This invention relates to a device for stopping a runaway ski which has become detached from a skier's foot after a fall by the skier. More particularly, the invention relates to a ski stopper which will only operate under the dynamic conditions encountered in a fall while skiing, and will not permit the ski to become detached from the skier's foot in a static drop situation.

The problem of preventing injury to other skiers resulting from being struck by a ski which has been released from a skier's foot after a fall has hitherto been solved by attaching the skis to the skier's legs by means of straps which operate independently of the bindings. Thus in a fall, the bindings will release the ski from the skier's boot, but the straps will retain the ski in relatively close proximity to the skier. While this solution will protect other skiers from injury from a runaway ski, it increases the occurrence of injury to the fallen skier from his own ski which remains strapped to his leg. This high incidence of injury to a skier from his own ski results from the skis' tendency to spin rapidly about the strap after the bindings release, a phenomenon known as "windmilling." Quite obviously, anyone near a windmilling ski can be seriously injured if struck by it.

The industry is well aware of the problem of injury to a fallen skier from his own skis, and this problem has resulted in a solution involving equipping the skis with a braking device which stops a runaway ski and at the same time doing away with the retaining straps. Most of the prior art braking devices operate by contacting the boot when the ski is being worn, with the boot serving to hold the brake in an inoperative position. When the ski becomes disconnected from the boot, the brake automatically is moved to an operative position where it engages the snow to stop the ski from sliding down hill, or flips the ski over so that the shovel of the ski will stop it from sliding down hill.

The problem with these prior art braking devices resides in the fact that they operate automatically whenever the ski becomes disconnected from the boot. U.S. Pat. No. 3,785,663 issued Jan. 15, 1974 to R. Spieldiener et al recognizes this problem and offers a partial solution which causes the ski brake to operate only when the ski is accidentally, or unintentionally released from the boot, as contrasted with intentionally removing the ski from the boot.

This solution, however, is incomplete in that there exist situations where it is undesirable to have the ski become disconnected from the skier even when the bindings accidentally release the ski from the boot. Such a situation exists when the skier is riding on a lift and one or both of his skis are released by the bindings for any reason. Ski lifts often pass above ski trails, thus the danger of being hit by a falling ski is a real one which exists with the prior art ski brake-equipped skis. Such a release is accidental, and yet there is no danger to the skier whose ski has thus been released, thus there is no need to have the ski become completely free of connection with the skier. The very real danger of a ski falling from the lift and hitting another skier on the trail below has prompted many ski resorts to consider banning the use of ski brakes from their slopes, and has even prompted states to consider outlawing such devices.

This invention offers a solution to this problem by providing a strap which is secured to the skier's leg and to the ski brake. The ski brake is not actuated by the ski leaving the skier's foot, but rather by the strap being disconnected from the ski brake. The strap is not disconnected from the ski brake as a result of a static drop of the ski, such as occurs when the ski falls off of the skier's foot while riding on a lift, but rather only as the result of a dynamic release such as occurs when the skier falls while skiing. This conrolled release can be accomplished in several ways, such as, for example, by establishing a minimum force for release, which force will be reached only in a dynamic release situation. Another way of accomplishing this result relates to the respective angles of release which occur in a static drop situation and a dynamic release situation. These angles are usually different and can be used to control disconnection of the ski from the skier's leg.

It is, therefore, an object of this invention to provide a device for stopping a runaway ski which has become detached from a skier during a fall by the skier.

It is a further object of this invention to provide a device of the character described wherein the ski will not be detached from the skier after being accidentally released from the skier's foot and subsequently being subjected to a static drop therefrom.

These and other objects and advantages of the invention will become more readily apparent from the following detailed description of several embodiments of the invention taken in conjunction with the accompanying drawings, in which.

Figure 9:
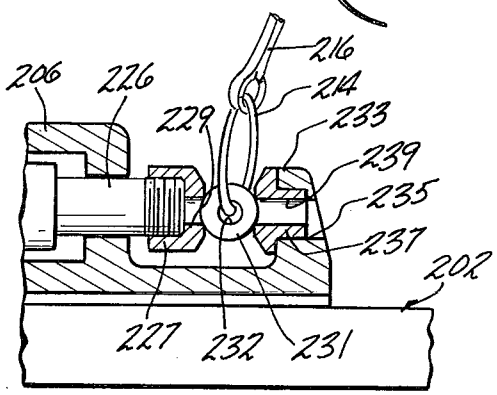
Figure 8:
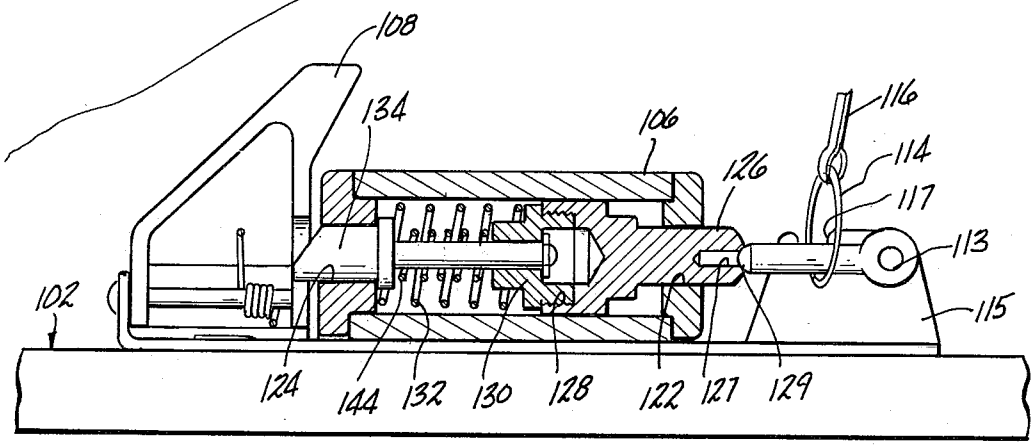

FIG. 8 is a vertical sectional view of a second embodiment of a ski stopper formed in accordance with this invention taken substantially along the longitudinal axis of the device; and FIG. 9 is a vertical sectional view of a portion of a third embodiment of a ski stopper formed in accordance with this invention and taken along the longitudinal axis of the device, the remainder of the device being as shown in FIG. 8.

Figure 1:
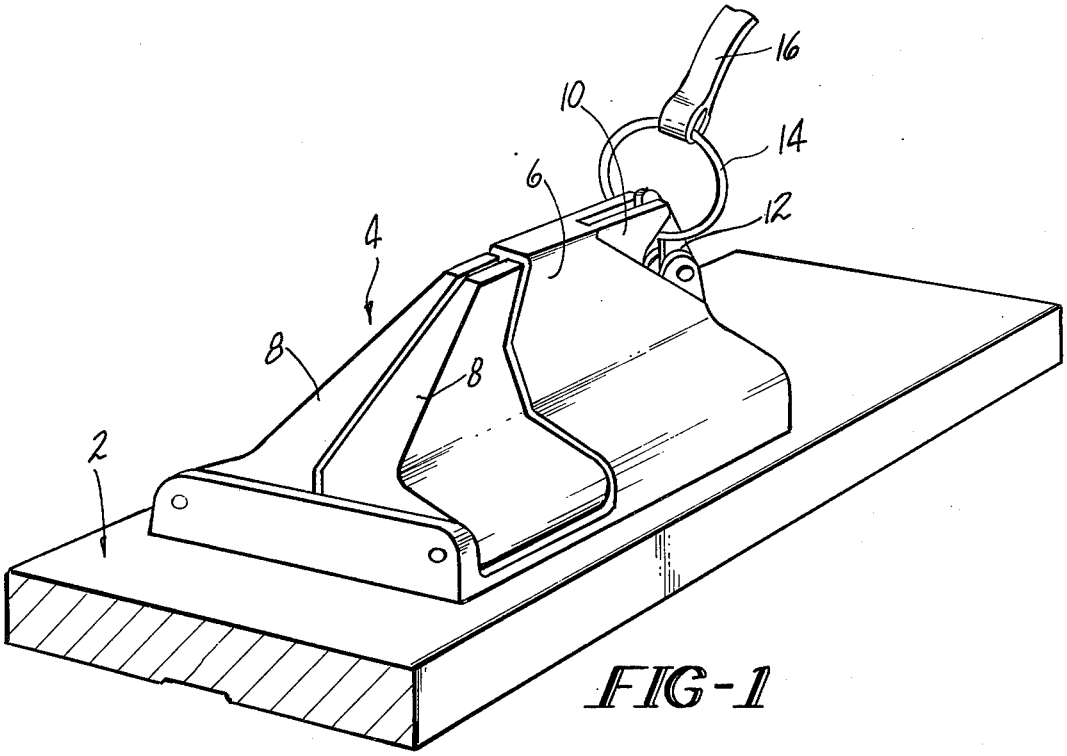
FIG. 1 is perspective view of a fragment of a ski showing an embodiment of a ski stopper made in accordance with this invention.

Referring now to the drawings, FIG. 1 shows a snow ski 2 on which is mounted an embodiment of the ski stopper of this invention which is designated generally by the numeral 4. The stopper 4 is mounted rearwardly of the ski bindings (not shown) and is of a width which is somewhat less than the width of the ski 2 so as to permit sharpening of bottom edges of the ski if necessary, and so as to permit easy handling of the skis while close together in transport or in parallel skiing manuevers. The stopper 4 includes a housing 6, a pair of braking elements 8 pivotally mounted on the housing 6, and shown in FIG. 1 in their folded or inactive positions. The housing 6 includes a forwardly extending bifurcated shoulder 10 at its upper leading edge, and there is a trigger element 12 pivotally mounted on the housing 6 and having its free end extending to a position between the bifurcations on the shoulder 10. It will be noted that there is thus formed on the stopper a releasable connection in the form of a closed loop with the shoulder 10 providing a fixed portion of the closed loop and the trigger 12 providing a movable portion of the closed loop. It will be appreciated that the closed loop can be opened by moving the trigger 12 away from the shoulder 10. As shown in FIG. 1, there is a ring 14 passing through the closed loop and the ring 14 is secured to a strap 16 which has its other end secured to the skier's boot in any conventional manner.

Figure 2:
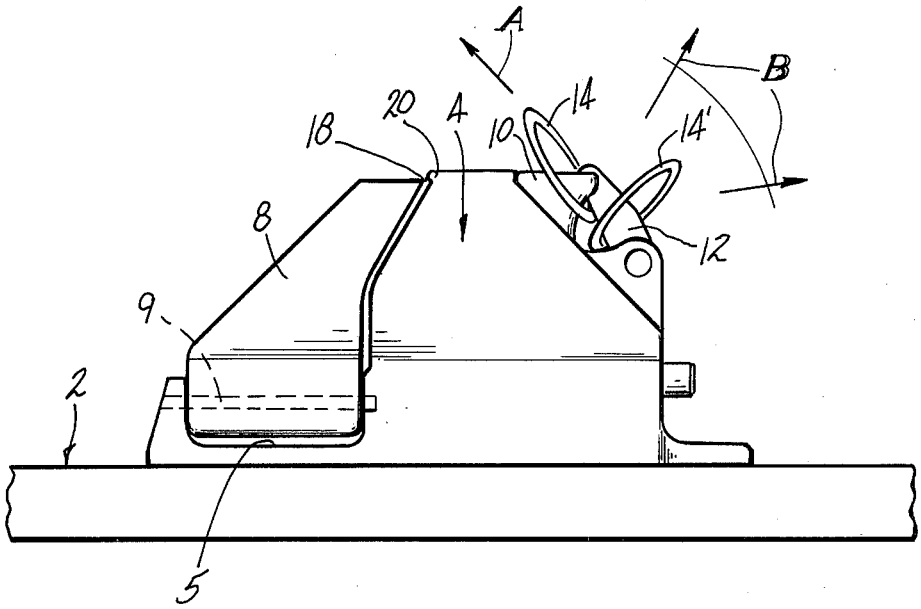
FIG. 2 is a side elevation of the embodiment of FIG. 1.

Referring now to FIG. 2, it will be noted that the housing 4 includes a rearward recess 5 in which each of the braking elements 8 is pivotally mounted on respective pins 9. The forward upper edge 18 is preferably sharp for cutting into icy snow and is recessed under an overhanging lip 20 formed on the housing 4 for safety purposes. It will be noted that the ring 14 is freely movable within the closed loop so that the ring can be pulled in a variety of directions in response to the ski bindings releasing the skier's boot and the ski then moving away from the skier's foot. It will further be noted that if the ring 14 is pulled generally rearwardly of the ski 2 in the direction of the arrow A, the ring 14 will be pulled against the fixed shoulder 10 and the closed loop will not open. Thus the ski will remain attached to the skier's boot by means of the strap 16. In the event, however, that the ring 14 is swiveled to the position 14' and pulled in the direction of the angle subtended by the arrows B, or generally forwardly of the ski, the ring 14 will be pulled against the trigger 12 which will pivot so as to open the closed loop thus pulling the ring 14 free of the ski and brake. In the latter event the ski will be free of connection with the skier and will slide independently of the skier.

Figure 3:
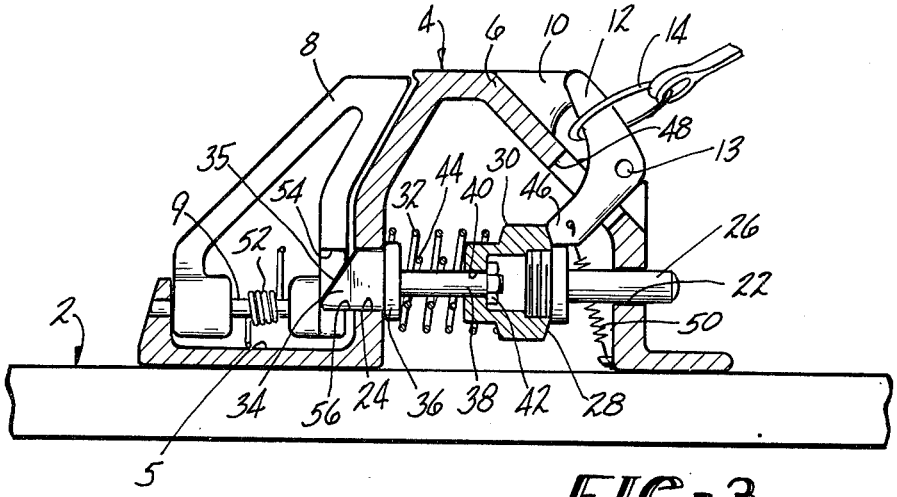
FIG. 3 is a vertical sectional view of the ski stopper of FIG. 1 taken substantially along its longitudinal axis.

Referring now to FIG. 3, the internal construction of the braking device 4 is shown in a cocked or preactuated position. It will be noted that the housing 6 is hollow and thus serves to protect most of the moving parts of the device from ice and snow. The housing 6 includes a pair of coaxial openings 22 and 24. A cocking pin 26 extends through the opening 22 and is provided with an enlarged head 28 which is externally threaded and onto which is screwed a hollow cap 30. A coil spring 32 serves to bias the cap 30 and cocking pin 26 forwardly, or to the right as viewed in FIG. 3. A sear member 34 extends through the opening 24 and includes a flange 36 and a shank 38. The shank 38 extends through an opening 40 in the cap 30 and is retained therein by a nut 42 to form a lost motion coupling with the cap. A spring 44 biases the sear 34 rearwardly, or to the left as viewed in FIG. 3. Thus the sear 34, in the position shown in FIG. 3 is free to move to the right with respect to the cap 30 and cocking pin 26 and against the bias of the spring 44. The trigger 12 is pivotally mounted on the housing 6 by means of a pin 13, and the trigger 12 includes a foot 46 which extends through an opening 48 in the housing and engages the cap 30 to prevent the cap 30, cocking pin 26 and sear 34 from moving forward, or to the right as viewed in FIG. 3 under the influence of the spring 32. A trigger spring 50 biases the trigger 12 about the pin 13 and into engagement with the cap 30. Thus the trigger and sear arrangement is shown in FIG. 3 in its cocked or ready to release condition. As previously noted, the braking elements 8 are pivotally mounted on respective pins 9 secured to the housing 6, there being a spring 52 mounted on each pin 9 and engaging the associated braking element 8 and the housing recess 5 to bias each braking element 8 outwardly about its respective pin 9 toward an operative position, shown in FIG. 5. Each braking element 8 is provided with a recess 54 on its inner edge to form a shoulder 56 which engages the sear 34 as shown in FIG. 3. Thus the braking elements 8 are held by the sear 34 in a cocked position against the bias of the springs 52 about the pins 9. It will be noted that the sear 34 is provided with an inclined cam surface 35 whose function will be described below.

Figure 4:
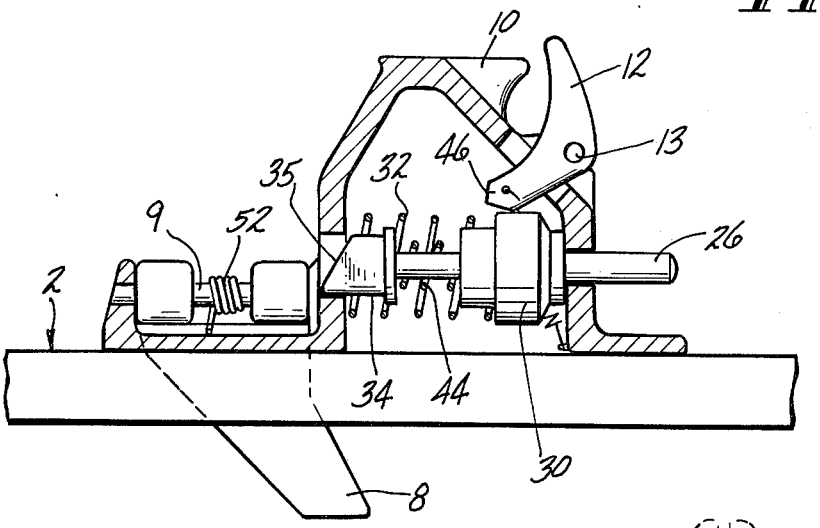
FIG. 4 is a vertical sectional view similar to FIG. 3 but showing the ski stopper in its actuated condition.
Figure 5:
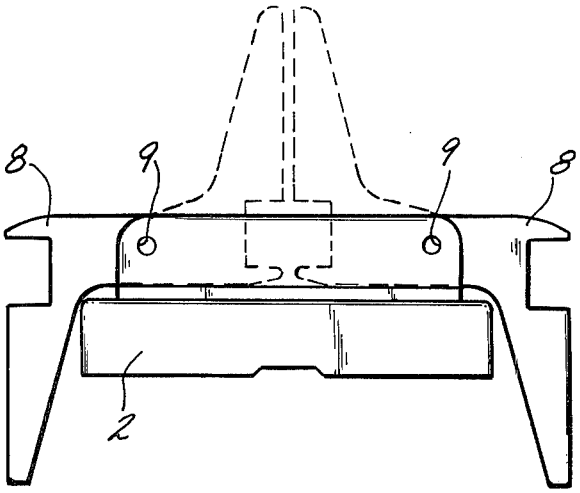
FIG. 5 is a rear elevational view of the embodiment of the preceding figures.

Reference is now made to FIGS. 4 and 5 which show the device in its deployed condition wherein it is operative to stop a runaway ski from sliding down a hill. It will be noted that the device is actuated only when the trigger 12 has been pulled about the pin 13 and away from the shoulder 10 so as to open the closed loop and allow the ring to escape from the device. When this happens the ski becomes free of connection with the skier and begins to slide freely down the slope. This pivotal movement of the trigger 12 lifts the trigger foot 46 out of engagement with the cap 30 whereupon the spring 32 pushes the cocking pin 26, cap 30, and sear 34 forward, or to the right as viewed in FIG. 4. The sear 34 is thus moved out of engagement with the braking element shoulders 56 and the springs 52 immediately pivot the braking elements 8 outwardly about their respective pins 9 to a ski-stopping position wherein the braking elements 8 extend below the bottom of the ski 2 and engage the snow to stop the runaway ski.

After the ski has been stopped and the skier has recovered it and wishes to put it back on for skiing, the stopper can be reset in the following manner. The ring 14 is draped on the trigger 12 and the cocking pin 26 is pushed rearwardly so as to return the sear 34, cap 30 and pin 26 to their respective positions shown in FIG. 3. The trigger spring 50 will automatically draw the trigger foot 46 down into retaining engagement with the cap 30, and pivot the trigger 12 about the pin 13 so as to close with the shoulder 10 and reform the closed loop on the device thereby retaining the ring 14 in place. The braking elements 8 are then pivoted back about their respective pins 9 against the bias of their respective springs 52 to their cocked positions shown in FIG. 3. As the braking elements 8 are returned to their cocked positions they pass over the sear camming surface 35 and momentarily depress the sear 34 forwardly until the braking device shoulder 56 clears the sear 34 whereupon the sear spring 44 automatically returns the sear rearwardly to its retaining position.

Figure 7:
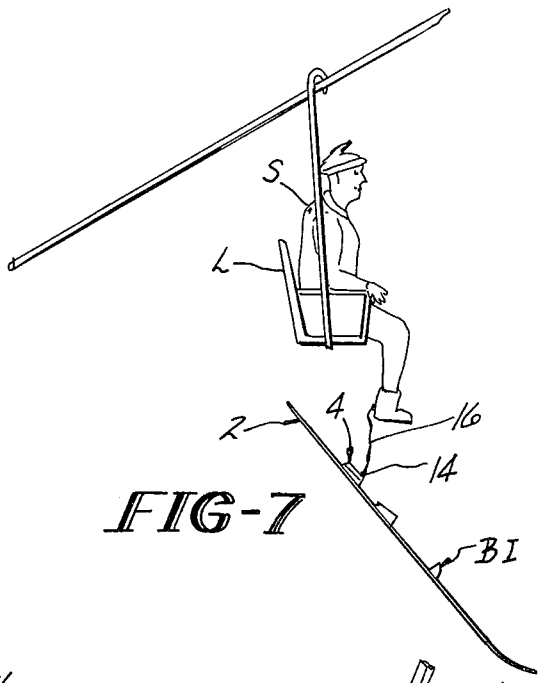
FIG. 7 is a side view of a skier seated on a lift chair with a ski being released from his bindings and showing how the device of this invention prevents the ski from falling to the ground.
Figure 6:
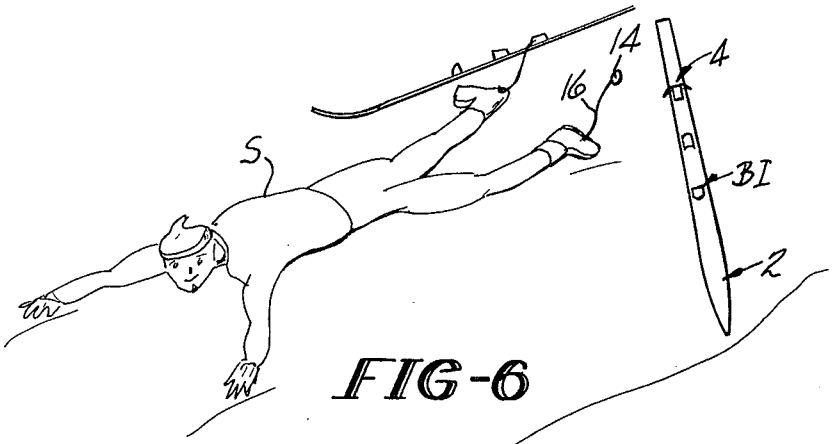
FIG. 6 is a perspective view of a skier falling while skiing and illustrating how the ski stopper is actuated in the event of such an occurrence.

Referring now to FIGS. 6 and 7 there is shown the conditions occurring in a dynamic release situation and a static drop situation respectively. In a dynamic release situation shown in FIG. 6 wherein the skier S is violently released from the skis 2, the skier will generally be thrown forward of the skis, or, after the bindings BI release, the skis will strike the snow and gyrate or windmill. In such a situation the ring 14 will be immediately pulled forward of the skis, or will, very shortly after release, be pulled toward the shovel of the skis, thereby moving in the direction of the arrows B shown in FIG. 2. The ring 14 will thus pull the trigger and be disconnected from the ski at the same time. Thus the ski is free of the skier and at the same time the stopper device is actuated to stop the runaway ski. Thus in a dynamic release situation, what occurs is a forceful release of the skis from the skier, which release may be followed by gyrations of the ski with respect to the skier due to the strap which still connect the ski to the skier's leg. In such a situation with the instant device, the strap will disconnect from the ski to allow the latter to move away from the skier thus putting the skier out of danger of being struck and injured by the flailing ski. The stopper will then immediately deploy thus protecting other skiers from being struck and injured by the loose ski.

In a static drop situation, such as is shown in FIG. 7, it is not desirable that the ski become completely detached from the skier because the ski could then fall and hit another skier. As previously noted, the stopping device 4 is mounted behind the bindings BI and thus is rearward of the center of gravity of the ski assembly. An example of a static drop situation is when the skier S is riding on a chair lift L and one or more of his skis are accidently released so that the ski then drops down away from the skier. In such a situation the ring 14 and strap 16, being connected to the skier's boot, will cause the ski to swing to a shovel-down position as shown in FIG. 7, this being due to the relative positioning of the stopper device 4 and the center of gravity of the ski assembly. When the ski swings to its shovel-down position, the ring 14 will be pulled by the strap 16 in the direction of the arrow A in FIG. 2. Thus the ring 14 is pulled against the housing shoulder 10, and will not open the closed loop. The ski therefore remains connected to the skier by means of the straps 16 and does not create any danger of falling onto other skiers beneath the lift. Thus in a static drop situation, which is a situation wherein the ski is accidently released by the bindings and falls away from the skier without being subjected to further impact with the ground or the like, and without creating any danger to the skier from whom it has been released, the stopper device of this invention will prevent the released ski from becoming completely disconnected from the skier due to the angular position assumed by the ski during the static drop, thus preventing injury to other skiers.

It will thus be readily appreciated that the embodiment of the invention shown in FIGS. 1–7 operates on the principal of direction of release of the ski from the skier's foot, and further, on what occurs after the ski is released in a dynamic release situation and a static drop situation It will further be appreciated that the desired result can be achieved independently of the angle of release of the ski by modifying the embodiment shown in FIGS. 1–7 and relying on the forces imposed on the stopper in a dynamic release situation as contrasted with a static drop situation.

FIGS. 8 and 9 disclose additional embodiments of the invention which rely on the magnitude of release forces in the two situations to accomplish the result.

Referring now to FIG. 8, there is disclosed a modification of the previously described device which depends on magnitude of force to disconnect the ski from the skier and actuate the stopper. The device includes a housing 106 having aligned openings 122 and 124 in which are slidably mounted a cocking pin 126 and sear 134 respectively. The cocking pin 126 includes an internally threaded end portion 128 which is screwed onto a cap 130. A spring 132 biases the cap 130 and cocking pin 126 forwardly, or to the right as seen in FIG. 8. A sear spring 144 biases the sear 134 rearwardly or to the left as seen in FIG. 8. The braking elements 108 operate as previously described and are cocked and held in place as previously described. The front end of the cocking pin 126 is provided with a recess 127 which provides a socket for the reception of a rounded end surface 129 of a trigger 112. The trigger 112 is pivotally mounted on a pin 113 secured to a bracket 115, which in turn is secured to the ski 102. The bracket 115 includes a clevis 117 which combines with the trigger 112 when cocked as shown in FIG. 8, to form a closed loop in which the ring 114 is disposed. When the ring 114 is pulled by the strap 116 with sufficient force to pivot the trigger 112 upwardly about the pin 113, the closed loop will open and the ring 114 will pull free of the stopper and ski. The stopper will then be actuated in the manner previously described. It will be noted that the quantum of force needed to disengage the trigger 112 and free the ski can be varied by varying the force of the spring 132 from unit to unit, or by adjusting the position of the pin 126 by means of its threaded connection with the cap 130. It will be readily appreciated that the force applied to the trigger 112 by the ring 114 in a static drop situation will be substantially less than that applied in a dynamic release situation. Thus the pin 126 can be preset so as to remain in contact with the trigger 112 in a static drop situation, whereas the trigger 112 will disengage from the pin 126 in a dynamic release situation.

Referring now to FIG. 9, there is disclosed the release portion of a third embodiment of the invention. The portion in the interior of the housing 206 is not shown since it is the same construction as is shown in FIG. 8. The cocking pin 226 has its forward end threaded and a cap 227 is screwed onto the pin 226. The cap 227 has a passage 229 which forms a socket for receiving a ball 231. The housing 206 includes a forward bracket 233 having a bore 235 in which is press fitted a bushing 237 having a passage 239. The bushing passage 239 provides a socket for receiving the ball 231. The ball 231 is thus held in place between the opposing sockets by the force of the cocking pin spring (not shown). The ball 231 is provided with a passage 232 through which a ring 214 passes, the ring 214 being secured to a strap 216 which in turn is secured to the skier's leg. It will be appreciated that when a sufficiently high pulling force is exerted on the ball 231 by the ring and strap, the ball will be pulled free of the stopper device thus freeing the ski 202 of connection to the skier. Once the ball 231 is free of the stopper device, the cocking pin 226 will move forward and the braking elements will be deployed as previously described. As before, the quantum of force needed to free the ball 231 from the stopper can be preset so as to be exceeded in a dynamic release situation, but not reached in a static drop situation. Thus the ski will not separate from the skier in a static drop situation, but will separate from the skier in a dynamic release situation. Once the ski becomes completely disconnected from the skier, the braking device is actuated to stop the runaway ski.

From the above, it will be readily appreciated that the ski stopper of this invention affords several advantages over the prior art devices, the foremost of which resides in the fact that a ski which is released from a skier's foot in a static drop situation will not become completely disconnected from the skier, while a ski released from the skier's foot in a dynamic fall situation will completely disconnect from the skier and will be stopped from thereafter sliding freely down a slope by the stopper mechanism. The device, furthermore, will not operate when the skier intentionally steps out of his skis for any reason. The stopper operates independently of the ski binding and does not require any component which extends beneath the boot or is biased against the boot. The stopper does not interfere with sharpening of ski edges since it lies wholly within the side surfaces and on the upper surface of the ski when cocked. The stopper includes a housing which contains and protects moving parts from snow and ice. The device is easy to cock, merely requiring a pushing in of the cocking pin and a subsequent setting of the braking wings to their seared positions.

Since many changes of the disclosed embodiments of the invention may be made without departing from the inventive concept, it is not intended to limit the invention otherwise than as required by the appended claims.

What is claimed is:

1. A ski stopping device for mounting on a ski having separate bindings for releasably securing the ski to a skier's boot, said device comprising:

a. braking means movable between a cocked position and a deployed position, said braking means being operable, when in said deployed position, to stop the ski from sliding;

b. means operable to bias said braking means toward said deployed position;

c. searing means operable when cocked to engage said braking means to retain the latter in said cocked position;

d. cocking means for cocking said searing means;

e. strap means adapted to be secured to the skier's boot;

f. releasable connection means for connecting said strap means to said device, said cocking means being movable, when said searing means is cocked, into engagement with said releasable connection means;

g. means for biasing said cocking means against said releasable connection means with a predetermined quantum of force whereby said strap means will remain secured to said device when pulled away from said device with a force lower than said predetermined quantum, and said strap means will become disconnected from said device when pulled away from said device with a force exceeding said predetermined quantum; and h. said cocking means being operable to release said searing means from its cocked condition only when said strap means has become disconnected from said device and said releasable connection means has been disengaged from said cocking means.

2. A ski stopping device for mounting on a ski having separate bindings for releasably securing the ski to a skier's boot, said device comprising:

a. braking means movable between a cocked position and a deployed position, said braking means being operable, when in said deployed position, to stop the ski from sliding;

b. means operable to bias said braking means toward said deployed position;

c. searing means operable to releasably engage said braking means for retaining the latter in said cocked position;

d. first means forming a releasable connection for a strap which is secured to the skier's boot, said first means selectively maintaining and breaking the connection with the strap in response to the quantum of force with which the strap is pulled away from the device, the connection being maintained by forces up to a predetermined quantum encountered when the ski experiences a static drop from the boot, and broken by forces exceeding said predetermined quantum; and e. second means operably interconnecting said first means and said searing means for enabling disengagement of said searing means from said braking means only when the connection between the strap and the device has been broken.

* * * * *